US006059577A

United States Patent [19]

Eriksson

[11] Patent Number: 6,059,577

[45] Date of Patent: May 9, 2000

[54] CONTACT PARTS FOR TRUCK CIRCUIT BREAKER

[75] Inventor: Björn Eriksson, Prestfoss, Norway

[73] Assignee: ABB AB, Västerås, Sweden

[21] Appl. No.: 09/180,936

[22] PCT Filed: May 14, 1997

[86] PCT No.: PCT/SE97/00792

§ 371 Date: Apr. 29, 1999

§ 102(e) Date: Apr. 29, 1999

[87] PCT Pub. No.: WO97/44800

PCT Pub. Date: Nov. 27, 1997

[30] Foreign Application Priority Data

May 23, 1996 [SE] Sweden ..... 9601966

[51] Int. Cl.[7] ..... H01R 39/00

[52] U.S. Cl. ..... 439/8

[58] Field of Search ..... 439/6, 8, 9, 70, 439/252, 851, 821

[56] References Cited

U.S. PATENT DOCUMENTS

| | | | |
|---|---|---|---|
| 2,430,270 | 11/1947 | Bergan | 173/363 |
| 3,459,873 | 8/1969 | Harris et al. | 174/86 |
| 5,730,606 | 3/1998 | Sinclair | 439/70 |
| 5,766,021 | 6/1998 | Pickles et al. | 439/70 |
| 5,887,344 | 3/1999 | Sinclair | 29/843 |

FOREIGN PATENT DOCUMENTS

| | | |
|---|---|---|
| 0603762 | of 1994 | European Pat. Off. . |
| 2 028 177 | of 1971 | Germany . |
| 24 41 117 | of 1976 | Germany . |
| 572 672 | of 1976 | Switzerland . |

*Primary Examiner*—Steven L. Stephan
*Assistant Examiner*—Brian S. Webb
*Attorney, Agent, or Firm*—Pollock, Vande Sande & Amernick

[57] ABSTRACT

A contact device comprises two contact members with spherical contact surfaces which are displaced in relation to each other, and a push-on contact device which is supported by one of the contact members and which is insertable over the other contact member. The push-on contact device has a plurality of elongated contact fingers fixed relative to each other in a waist attachment, which is articulately attached to one contact member so as to make possible an angular position of the contact device of, for example, 5°.

7 Claims, 2 Drawing Sheets

CONTACT PARTS FOR TRUCK CIRCUIT BREAKER

TECHNICAL FIELD

The present invention relates to a contact device. The contact device is intended to electrically connect two sections of a current path which are displaceable in relation to each other. The device comprises two contact members, which are each fixed to one of the current path sections, and an elongated push-on contact supported by one of the contact members and displaceable in its longitudinal direction between an open position and a closed position.

The contact device is primarily intended for use with withdrawable apparatus which, during a short circuit, is traversed by high currents, for example truck-mounted high-voltage circuit breakers.

BACKGROUND OF THE INVENTION

During short-circuit breaking, a truck-mounted high-voltage circuit breaker is subjected to large ejection forces. The forces cause deflection of the breaker poles and attempt to move the truck in the direction of travel. If the movement becomes larger than the contact action, the breaker breaks down.

Patent EP-A-0 603 762 specification describes a special capture contact device adapted to eliminate the above-mentioned problems with withdrawable high-voltage apparatus. In this contact device, the current forces generated when the apparatus is traversed by short-circuit current are utilized to block the plug-in contacts of the apparatus in the operating position, thus preventing the risk of arcing between the contacts.

SUMMARY OF THE INVENTION

The object of the present is to provide a contact device intended for the above field of use, which is short-circuit proof without the use of the capture contact device and which may easily be adapted to different rated currents. In addition, the contact device is to be capable of operating satisfactorily also in case of relatively large lateral displacements between those sections of the current path which are to be connected.

The contact device according to the invention comprises a push-on contact device with a plurality of elongated contact fingers which are fixed relative to each other in a waist attachment. Each contact finger has a certain current-load capacity, and the number of fingers can be varied without any other parts in the contact device having to be changed. The contact device can therefore be adapted, in an extremely simple manner, to the rated current of the associated apparatus.

The push-on contact device makes contact, in the closed position, between two contact balls which are each fixed to one of the sections of the current path which are displaceable relative to each other. Since the waist attachment of the contact device is articulately fixed to the center of one of the contact balls, an angular position of the contact device of, for example, 5° in all directions is made possible. In this way, good conformance of the contact device is achieved, so that all the contact fingers will make contact with the contact balls with approximately the same contact pressure also when the contact device is positioned obliquely because the current path sections are laterally displaced relative to each other.

The contact fingers are made of a low-resistant material with good resilient properties and are clamped in the waist attachment in such a way that they will have a slight inward bend towards the center of the current path. In this way, approximately the same contact pressure is achieved independently of the position of the contact balls in the longitudinal direction. This makes possible the use of relatively long contact fingers, whereby the contact engagement can be made so large, for example 20 cm, that there will be no risk of contact separation because of the current forces which occur upon a short-circuit. In this way, the contact device fulfils the requirement for short-circuit safety without having to use special capture contact devices or taking other costly measures.

BRIEF DESCRIPTION OF THE DRAWINGS

The invention will be explained in greater detail with reference to the accompanying drawings, wherein.

DETAILED DESCRIPTION OF THE PREFERRED EMBODIMENTS

Figure 3:
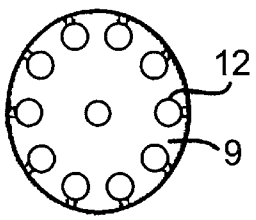
FIG. 3 shows a cross section along the line III—III in FIG. 2.
Figure 1:
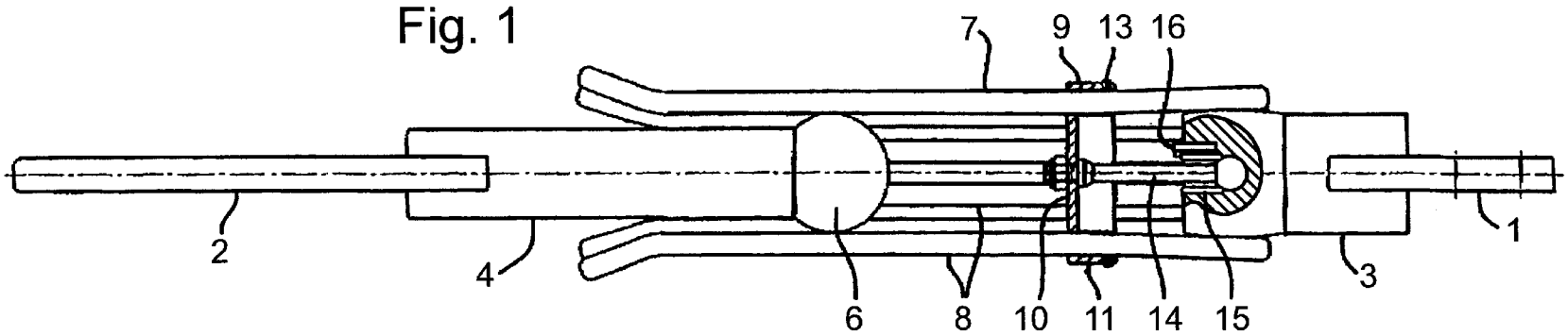
FIG. 1 shows, in a side view and partially in axial section, a first embodiment of a contact device designed according to the present invention.
Figure 2:
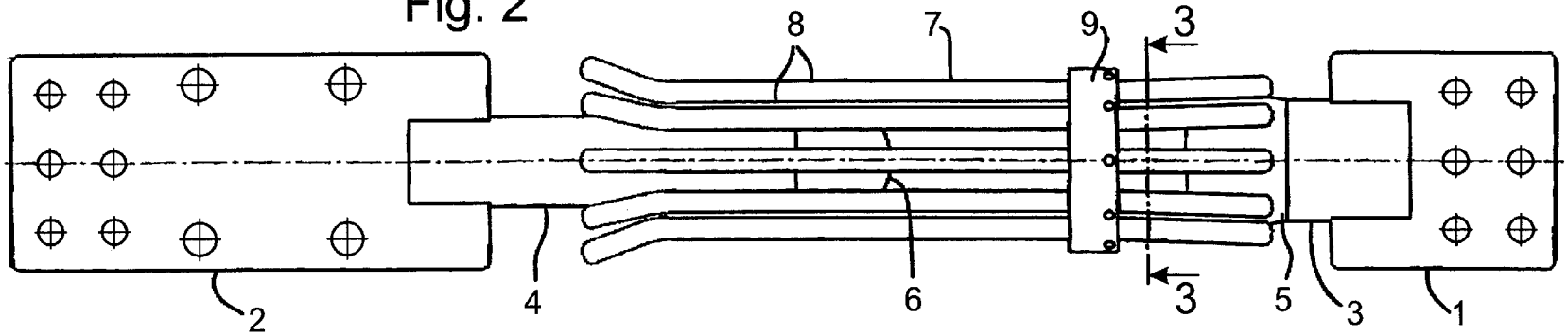
FIG. 2 shows the same contact device in a plan view.

The contact device shown in FIGS. 1–3 constitutes an electrical connection between two sections 1 and 2 of a current path, wherein the section 1 of the current path may, for example, be a connection member on a truck-mounted high-voltage circuit breaker, whereas the section 2 of the current path may be a connection member fixed to a stationarily mounted support insulator, the latter connection member being connected to a busbar or an output line. The contact device comprises a first contact member 3, which is fixed to the section 1 of the current path, and a second contact member 4, which is fixed to the section 2 of the current path. The free end portions 5, 6 of the contact members 3, 4 are partially ball-shaped with convex, preferably spherical contact surfaces and are referred to in the following as "contact balls". The contact member 3 supports a push-on contact device 7, which comprises ten elongated contact fingers 8 fixed relative to each other by means of a waist attachment 9 arranged at the mid-portion of the contact fingers. The waist attachment consists of a circular disc 10 with a surrounding edge portion 11 projecting from the plane of the disc, the thickness of the edge portion being larger than the diameter of the contact fingers. The edge portion is provided with through-holes 12, in which the contact fingers 8 are fixed with the aid of stop screws 13. The holes are angularly displaced at even mutual distances along the periphery of the disc 10, and the contact fingers will thus form a rotationally symmetrical configuration. The holes are further obliquely directed at an angle of about 1° with the plane of the disc 10, which means that, in the open position of the contact device, the contact fingers will be inclined obliquely inwardly in the direction of insertion, thus obtaining the required contact pressure against the contact ball 6 in the closed position.

The waist attachment 9 is articulately fixed to the contact member 3 by means of a ball-type bolt 14, which by one end is fixed to the center of the disc 10 and by its other, ball-shaped end is journalled in a cavity in the centre of the contact ball 5 in such a way that an angular position of the push-on contact of about 5° in all direction is made possible. The ball-type bolt is secured to the cavity of the contact ball by means of a locking sleeve 15 with a mounting bolt 16.

The contact fingers 8 are made of a low-resistant material with good resilient and corrosion properties, for example chromium zirconium copper or beryllium copper. The contact members 3, 4 with their contact balls 5, 6 are preferably made of electrolytic copper. Both the contact fingers 8 and the contact members 3, 4 may advantageously be silver-plated. The other parts, such as the waist attachment 9, the ball-type bolt 14 and the locking sleeve 15, may suitably be made of stainless steel.

The free end portions of the contact fingers are obliquely outwardly bent and thus form together a funnel-shaped end portion of the push-on contact device 7. In this way it is ensured that the contact device 7 is guided towards the contact ball 6 also if the longitudinal axes of the contact members 3, 4 are somewhat laterally displaced relative to each other.

The number of contact fingers is chosen taking into consideration the rated current of the connected apparatus and the current-load capacity of the contact fingers, which, for example, may be 400 A per finger. However, the design requires that the number of fingers be at least three.

Figure 4:
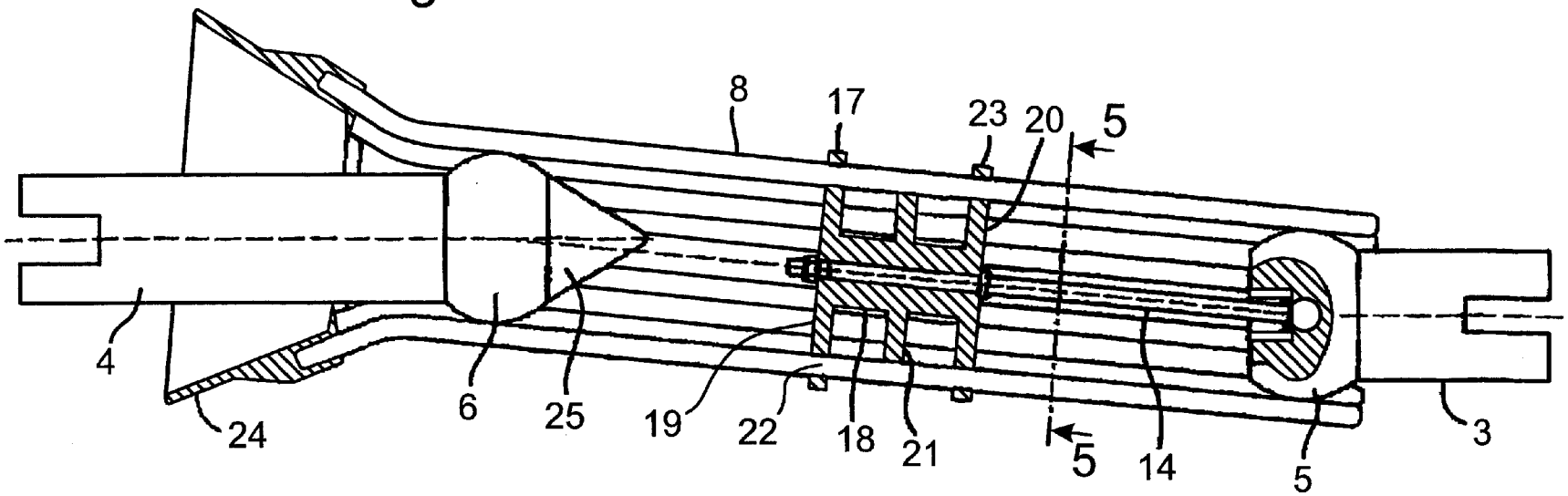
FIG. 4 shows, in axial section, a second embodiment of a contact device according to the invention.
Figure 5:
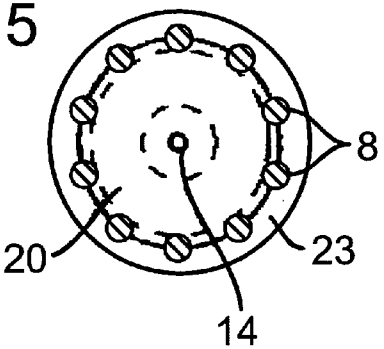
FIG. 5 shows a cross section along the line V—V in FIG. 4.

The contact device according to FIGS. 4 and 5 differs from that described above in that its waist attachment 17 consists of a centrally arranged cylindrical body 18 with two radially projecting end flanges 19, 20 and one center flange 21. The contact fingers 8 are fixed to the waist attachment 17 by passing through holes 22 disposed at even mutual distances along the periphery of one end flange 19 and being locked to the other end flange 20 with the aid of a clamping ring 23. The diameter of the center flange 21 is adapted so that, when clamping the contact fingers 8 to the waist attachment 17, the two ends of the fingers are bent inwardly towards the centre of the current path through an angle of about 1°. In this way, approximately the same contact pressure is obtained independently of the position of the contact balls 5, 6 in the longitudinal direction. The flanges 19–21 need not be integrated into the body 18 but may alternatively consist of three separate, axially spaced-apart fixed circular discs.

To ensure that the push-on contact 7 is guided towards the contact ball 6 also when the contact members 3 and 4 are not aligned with each other, the contact device 7 is provided with a plastic guiding funnel 24 and the contact ball 6 is provided with a plastic cone 25.

The invention is not limited to the embodiments shown but several modifications are possible within the scope of the patent claims.

What is claimed is:

1. A contact device for electrical connection between two sections of a current path which are displaceable in relation to each other, said device comprising a first and a second contact member each fixed to one of the sections of the current path, and an elongated push-on contact device supported by the first contact member, said push-on device together with the first contact member being displaceable in its longitudinal direction between an open position, in which the two contact members are electrically separated from each other, and a closed position, in which the push-on contact device connects the two contact members wherein the contact members exhibit partially ball-shaped end portions with convex contact surfaces, and the push-on contact device comprises at least three contact fingers, fixed relative to each other in a preferably rotationally symmetrical configuration by a waist attachment arranged at the mid-portion of the contact fingers, said waist attachment being articulately attached to said first contact member, the contact fingers being adapted to make contact, in the closed position under contact pressure, with the convex contact surfaces of the contact members.

2. A device according to claim 1, characterized in that the contact fingers (8) are made of a low-resistant material with good resilient and corrosion properties, for example chromium zirconium copper and beryllium copper.

3. A device according to claim 1, wherein the partially ball-shaped end portion of said first contact member has a centrally disposed cavity, in which said waist attachment is articulately journalled by a ball-type bolt extending in the longitudinal axis of the push-on contact device.

4. A device according to claim 1, wherein the waist attachment comprises a preferably circular disc which along its periphery is provided with through-holes for fixing the contact fingers, the holes being obliquely directed towards the plane of the disc so that the contact fingers in the open position are inclined slightly inwardly towards the insertion direction.

5. A device according to claim 1, wherein the waist attachment comprises three parallel and preferably circular discs, which through a central body are fixed relative to each other at an axial distance so that a center plate is placed between two end plates, the two end plates along their periphery being provided with through-holes and/or members for fixing the contact fingers, whereas the diameter of the center plate is adapted so that, when clamping the contact fingers to the waist attachment, the two ends of the fingers are bent inwardly towards the center line of the push-on contact device.

6. A device according to claim 1, wherein the push-on contact device has a funnel-shaped end portion for guiding towards said second contact member.

7. A device according to claim 1, wherein said second contact member is provided with a guiding cone of electrically insulating material.

* * * * *